US007784997B2

(12) United States Patent
Neumann

(10) Patent No.: US 7,784,997 B2
(45) Date of Patent: Aug. 31, 2010

(54) CLOSED SINGLE-USE SYSTEM FOR MIXING, STORING AND HOMOGENIZING LIQUIDS IN CLEAN OR STERILE CONDITIONS

(75) Inventor: Christian Neumann, Marseilles (FR)

(73) Assignee: Sartorius Stedim Biotech SA, Aubagne (FR)

( * ) Notice: Subject to any disclaimer, the term of this patent is extended or adjusted under 35 U.S.C. 154(b) by 1065 days.

(21) Appl. No.: 10/563,257

(22) PCT Filed: Jul. 1, 2004

(86) PCT No.: PCT/FR2004/001700

§ 371 (c)(1),
(2), (4) Date: Jul. 5, 2006

(87) PCT Pub. No.: WO2005/011852

PCT Pub. Date: Feb. 10, 2005

(65) Prior Publication Data

US 2007/0064519 A1 Mar. 22, 2007

(30) Foreign Application Priority Data

Jul. 4, 2003 (FR) ..... 03 08203

(51) Int. Cl.
*B01F 15/02* (2006.01)

(52) U.S. Cl. ..... 366/137

(58) Field of Classification Search ..... 366/136–137; 137/563

See application file for complete search history.

(56) References Cited

U.S. PATENT DOCUMENTS

| | | | | |
|---|---|---|---|---|
| 3,647,397 | A * | 3/1972 | Coleman | 366/167.1 |
| 5,121,857 | A * | 6/1992 | Hutchinson | 222/318 |
| 5,362,642 | A * | 11/1994 | Kern | 435/404 |
| 5,385,564 | A * | 1/1995 | Slater et al. | 604/416 |
| 5,941,635 | A | 8/1999 | Stewart | |
| 5,972,223 | A | 10/1999 | Jonsson et al. | |
| 6,071,005 | A | 6/2000 | Ekambaram et al. | |
| 6,113,793 | A | 9/2000 | Jonsson et al. | |
| 6,296,762 | B1 | 10/2001 | Jonsson et al. | |
| 6,361,798 | B1 * | 3/2002 | Thanoo et al. | 424/489 |
| 6,395,180 | B2 * | 5/2002 | Chioini et al. | 210/646 |
| 7,278,780 | B2 * | 10/2007 | Goodwin et al. | 366/273 |
| 7,431,494 | B2 * | 10/2008 | Zambaux | 366/144 |
| 2003/0231546 | A1 * | 12/2003 | Bibbo et al. | 366/276 |
| 2007/0064519 | A1 * | 3/2007 | Neumann | 366/136 |

FOREIGN PATENT DOCUMENTS

GB 308 254 A 6/1930

* cited by examiner

*Primary Examiner*—Charles E Cooley
(74) *Attorney, Agent, or Firm*—Young & Thompson

(57) ABSTRACT

A closed single-use system for mixing, storing and homogenizing liquids, comprising an assembly constituted by a rigid container (1) fitted with a non-invasive pump (4), the container (1) enclosing a generally parallelepipedic single-use bag (2), the lower face and the upper face of which are connected in fixed manner by means of a mixing duct (3) which is inserted into the pump (4) and which, during operation, allows the closed-circuit circulation of the liquid in said bag (2), for example from the bottom of the bag to its top, the pump (4) being open so that the mixing duct (3) can be inserted into it and removed from it.

14 Claims, 8 Drawing Sheets

CLOSED SINGLE-USE SYSTEM FOR MIXING, STORING AND HOMOGENIZING LIQUIDS IN CLEAN OR STERILE CONDITIONS

The present invention relates to a closed single-use system for mixing, storing and homogenizing liquids in clean or sterile conditions, which can preferably be used in the biopharmaceutical, pharmaceutical and medical industries.

BACKGROUND OF THE INVENTION

In the medical, biopharmaceutical, pharmaceutical or paramedical fields, but also in other fields such as in particular that of food, the problem arises of the mixing of large volumes of fluids in clean or sterile conditions.

The mixing of liquids in clean or sterile conditions is a common operation which must often meet the following criteria:

- the maintenance at the lowest possible level of an initial biocharge in the constituents of the mixture and in the mixture itself;
- as limited as possible an endotoxins content in the constituents of the mixture and in the mixture (and often the combination of the two criteria above);
- in more critical conditions, also the maintenance of the sterility of the constituents of the mixture and of the resulting mixture;
- in even more special conditions, in addition to the above criteria, the protection of the operators from the potential toxicity of the constituents of the mixture and of the mixture itself.

Currently, this type of mixing operation is generally carried out using stainless steel tanks fitted with a stirrer immersed in said tanks.

The cost of these tanks is such that they must, naturally, be reusable. This involves a certain number of associated disadvantages and risks.

The most significant of these risks are the following:

- the need to prepare the tank in advance, which involves on-site cleaning, disinfection and pre-sterilization (CIP or Clean In Place) and on-site sterilization operations, for example using flowing steam (SIP or Steam In Place);
- the use of a tight-seal tank with a mixer, typically a mixer with propellers, immersed in the tank, necessitates the use of a stuffing box around the shaft of the mixer in order to make the system tight. Pre-sterilization and sterilization operations are costly, and these operations must be revalidated regularly, taking into account the ever increasing demands of the regulatory, health or other authorities;
- a risk of bacterial contamination, either through the opening of the tank, or through the stuffing box, even due to operator error;
- finally, the usual risk of cross-contamination between batches, which is a risk inherent in the re-use of equipment, may be cited.

It would therefore be desirable to have available a mixing system, preferably simple in design and structure, which satisfies all or some of the criteria mentioned above.

U.S. Pat. No. 5,941,635 describes a system comprising a bag fitted with several dip tubes, in which the liquid to be mixed is sampled in the middle of the bag, using one of the dip tubes, and said liquid returns via the bottom of the bag, by means of an internal tube comprising a mixing head, connecting the top and the bottom of the bag.

Apart from its complexity, this system involves operation inside the bag during its production, in particular in order to insert the dip tubes and the mixing head. There is therefore a significant risk of introducing pyrogenic particles.

SUMMARY OF THE INVENTION

This is why a subject of the present invention is a closed single-use system for mixing, storing and homogenizing liquids, comprising an assembly constituted by a rigid container fitted with a non-invasive pump, said container enclosing a generally parallelepipedic single-use bag, characterized in that the lower face of the bag contains an orifice for the liquid to discharge to the outside of the bag, the upper face contains an orifice for the return of the liquid through which said liquid returns to the inside of the bag, said orifices are connected in fixed manner by means of an external mixing duct which is inserted into the pump which, during operation, allows the closed-circuit circulation of the liquid taken from the bottom of said bag, the pump being open so that the mixing duct can be inserted into it and extracted from it.

The container can of course be reusable. On the other hand, the bag and its duct can be used once.

The sampling of the liquid is carried out entirely at the bottom of the bag through the orifice for the liquid to discharge to the outside of the bag. It then flows through the external mixing duct, driven by the pump. The liquid returns to the inside of the bag through the top, and it runs onto the upper surface of the liquid present in the bag.

In preferred embodiments of the invention, the external mixing duct is fixed by each of its ends to the surface of the bag, without a dip tube or comprises a short dip tube, less than 2 cm long, in particular less than 1 cm.

In other preferred embodiments of the invention, the non-invasive pump is a peristaltic pump fitted with a rotor which compresses the external mixing duct with the help of two or three blocks and thus pushes the product with each rotation towards delivery.

In order to better understand the cooperation between the container and the bag, the operating mode of the liquids-mixing system is explained below. The assembly can operate as follows:

A bag is introduced at the top of a container, the duct is inserted into the pump, then the pump is actuated in order to create a closed-circuit circulation of the liquid or liquids introduced into the container in order to carry out the mixing. The dimensions of the duct (length, diameter) and its flexibility must of course be compatible with the criteria of the pump chosen.

The liquids to be mixed can be introduced into the bag by aseptic connection under a laminar air flow hood to the sources of these liquids in particular by a single-use sterile-connection device for example of the KLEENPAK® Connector type marketed by PALL Corporation and preferably when said bag is in place in the container.

In the present application and hereafter the term "container" describes for example a generally paralellepipedic stainless steel receptacle, preferably made of 304L or 316L stainless steel of parallelepipedic shape, the capacity of which is in particular suited to that of the bag installed in the latter, and in particular a receptacle of the type for example described in EP-A-1 012 073. The container is advantageously fitted with a metal casing, in particular of stainless steel.

The pump can be installed above or preferably below the location provided for the bag.

In preferred embodiments of the invention, the bottom of the container is fitted with an elongated slit allowing the insertion and the passage of the mixing duct.

A device which can in particular be shifted parallel to the bottom of the container such as a flat slide valve is advantageously provided in order to partially close the slit, which allows the mixing duct to pass through while minimizing the free surface of the slit, and thus allows effective support of the bottom of the bag.

In other preferred embodiments of the invention, the above container contains one or two side doors in order to allow the installation of the bag.

In further preferred embodiments of the invention, the above container is fitted with a bottom wall which can be shifted horizontally, preferably removable in the manner of a slide valve, fitted with one or more, in particular two, elongated slits.

In further preferred embodiments of the invention, the flaps of the doors comprise a vertical U-section, the openings facing each other, into which a profiled plate is slid and adjusted so as to keep the door flaps held in the closed position. The central part of this plate is preferably coplanar with the internal surface of the two doors.

In further preferred embodiments of the invention, the flap of a side door comprises a gate fitted with fastenings cooperating with systems provided on the other side door in order to keep the door flaps in the closed position. The central part of this gate is preferably coplanar with the internal surface of the two doors of the container.

In further preferred embodiments of the invention, the flaps of two side doors comprise a U-section, the openings facing away from each other, into which a profiled and adjusted plate is slid comprising two U-bends, the openings facing each other, in order to keep the door flaps in the closed position. The central part of this plate is preferably coplanar with the two doors and advantageously forms a channel in which the mixing duct can be installed in order to protect it, preferably using a gate flap.

In further preferred embodiments of the invention, the protection for the mixing duct is integrated in a door of the container and preferably comprises a gate leaf.

A cover, in particular such as that described in EP-A-1 012 073, can advantageously be provided above the bag.

In the present application and hereafter, the term "bag" describes for example a generally parallelepipedic container made of flexible plastic, preferably transparent in order to be able to visually observe the cloudiness of the contents and in particular one of those described in EP-A-1 012 227.

Its capacity can be for example from 25 to 3000 liters, preferably from 50 to 1500 liters and in particular from 50 to 500 liters.

It can be made for example from flexible plastic film based on polyethylene (PE), ethylene, vinyl acetate (EVA), polypropylene (PP) or advantageously a combination of these materials, preferably made of flexible co-extruded or laminated multi-layered, multiple-material laminated film and in particular made of a single multi-layered laminated film such as is described in EP-A-1 012 227.

It can comprise for example from 1 to 8, in particular from 1 to 4 tubes welded or bonded onto flues provided on the top of the bag, one of the tubes being the duct above and 1 or more, in particular 1 or 2 bungholes at the bottom, one of the bungholes communicating with the duct above.

The pump which can be used is of the non-invasive type. A non-invasive pump is a pump which acts on the circulation of a fluid without the pump being in contact with the fluid. The pump which can be used is preferably a pump with several pump heads and in particular of the peristaltic type. Those marketed by the company WATSON MARLOW of the 700 series can be cited for example.

The duct can be made for example from thermoplastic elastomer, preferably from MARPRENE® and in particular from platinum-catalyzed silicone. Its internal diameter can advantageously be comprised between 6 and 40 mm, preferably comprised between 9 and 31 mm, quite particularly comprised between 12.70 and 19.10 mm.

It can advantageously contain, upstream and/or downstream of the pump, branches serving for example to add preferably liquid compounds after the initial filling or on the other hand to draw off some of the mixture, for example for sampling or also for drainage.

The liquid-mixing systems of the present invention have remarkable features:

- the number of connections in aseptic conditions is limited to the maximum, which reduces the risk of contamination of the products through contact with the operator's hands;
- as the system is closed, it is protected from the ambient air, which consequently reduces the risks of bacterial contamination and limits the risks of oxidation;
- also as a result of the closed nature of the system, the operator is not exposed to the possible toxicity of one of the constituents of the mixture or of the mixture itself.

The system according to the invention allows the mixing of liquids in a closed circuit.

Being single-use, the system of the invention eliminates any risk of cross-contamination between different batches.

These features justify the use of the systems described above in numerous applications, bringing them the advantages described above.

For example in the field of biotechnologies, the systems of the invention allow the preparation of cell culture media to be transferred into a bioreactor, by dissolution of a mixture of powders in water for injectable preparations. The addition to culture media of foetal calf serum, for example in order to produce a medium with 10% of foetal calf serum, and the obtention of a homogenized mixture, can also be mentioned.

The adjustment of the pH or of the conductivity of a culture medium by means of acid, basic or saline solutions and homogenization of the mixture can equally be mentioned.

The preparation of buffer solutions intended for chromatography columns or for tangential filtration systems, in operations for the separation and or purification of compounds, and their homogenization, can also be mentioned.

In all these cases the mixing is carried out, thanks to the systems according to the invention, in sterile conditions, no matter what the stage of the biotechnological process, in accordance with the requirements or recommendations of the regulatory authorities.

In the pharmaceutical field, a standard application is for example, in traditional pharmacy, the bulk pharmaceutical formulation of solutions of injectable products, in particular cytotoxics such as anti-cancer drugs, and their bulk storage before pharmaceutical division into their final unit-dose packaging, for example in injection ampoules. Such an operation can be carried out thanks to the system according to the invention in a single stage, or be divided into two stages, preparation of a concentrated solution first, followed by dilution.

In fact, the toxic nature of these solutions requires such mixing to be carried out in a closed system, even in a confined environment.

In the medical field, one application is for example, in parenteral nutrition, the preparation of master batches of nutritive mixtures to be subsequently divided into multiple administration bags, starting from base solutes or suspensions such as amino acid solutions, glucose solutions, and/or lipid emulsions.

All these features justify the use of the mixing systems described above in a method for mixing compounds.

The closed single-use systems according to the invention are intended for the mixing of liquids.

This is why a subject of the present application is also a method for mixing compounds, characterized in that, in a rigid container fitted with a non-invasive pump, a single-use bag is introduced above, the lower face and the upper face of which are connected in fixed manner by means of a mixing duct, the duct is inserted into the pump, and the pump is actuated in order to produce a closed-circuit circulation of the liquid or liquids introduced into the container in order to carry out the mixing.

In preferred embodiments of the method described above, the pump causes the mixture to circulate with a flow rate of 6 to 1500 liters per minute, preferably of 10 to 1000 liters per minute, quite particularly of 10 to 750 liters per minute.

In other preferred embodiments of the invention, the generally parallelepipedic system is arranged so as to create turbulences during the recirculation through the duct, which facilitates the mixing of the contents.

The preferred embodiments of the closed single-use systems described above also apply to the other subjects of the invention mentioned above, in particular to the methods for the preparation of mixtures.

BRIEF DESCRIPTION OF THE DRAWINGS

The invention will be understood better if reference is made to the attached drawings in which.

DESCRIPTION OF PREFERRED EMBODIMENTS

Figure 1:
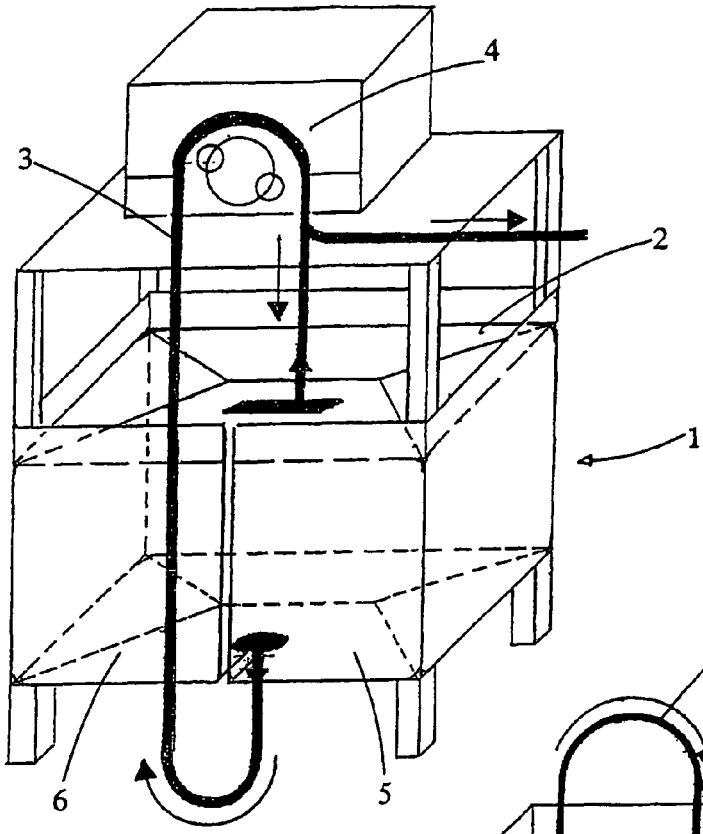
FIG. 1 represents an overall diagram of a single-use bag installed in its storage, transport and mixing device.

In FIG. 1, a container 1 enclosing a generally parallelepipedic single-use bag 2 is seen. The lower face of the bag 2 includes an orifice for the liquid to discharge to the outside of the bag, and the upper face includes an orifice for the liquid to return, through which said liquid runs into the inside of the bag 2. The two orifices of the bag 2 are connected in fixed manner by means of a mixing duct 3.

This fixed mixing duct 3 is functionally inserted into a pump 4 situated above the bag, which, by its rotation, allows the liquid to circulate, for example from the bottom of the bag to its top, in the direction indicated by the arrows.

The container 1 can be opened at the side thanks to two doors 5, 6 allowing the lateral opening of the container 1. It is thus easy to insert the bag 2 with its fixed duct 3 into the container 1, and to insert the mixing duct 3 into the pump 4 in the operating position.

Figure 2:
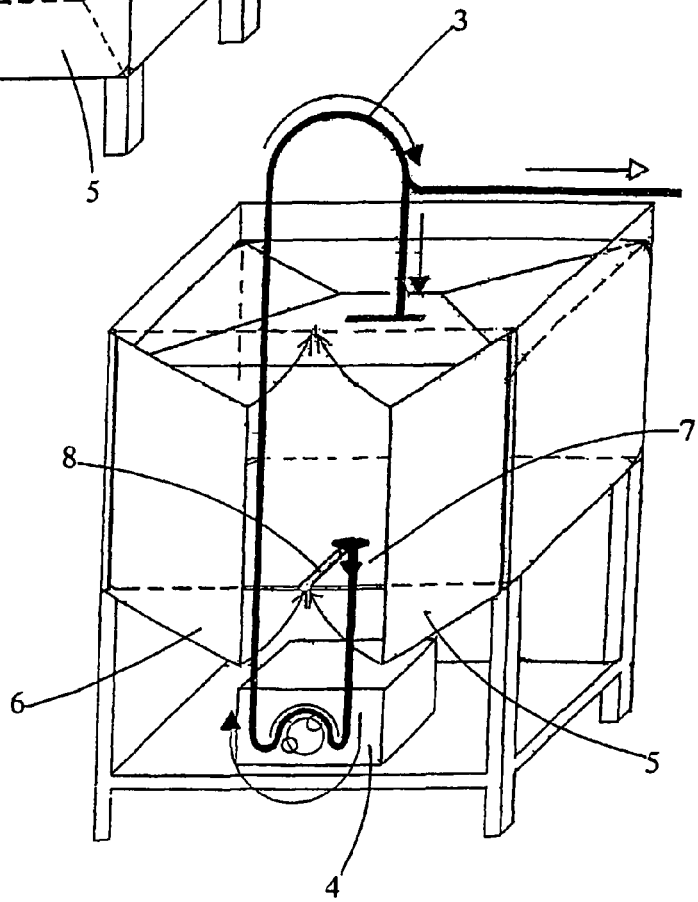
FIG. 2 represents an overall diagram of a single-use bag installed in its storage, transport and mixing device.

FIG. 2 is a variant of FIG. 1, in which the pump is installed below the bag instead of being installed above the bag as in FIG. 1. In this diagram, the doors 5, 6 of the container have been represented in a semi-open position. The bottom 7 of the container 1 can also be seen, which bottom 7 is intended to support the bag 2. The bottom 7 is fitted with an elongated slit 8 allowing the insertion and the passage of the fixed mixing duct 3.

Figure 3:
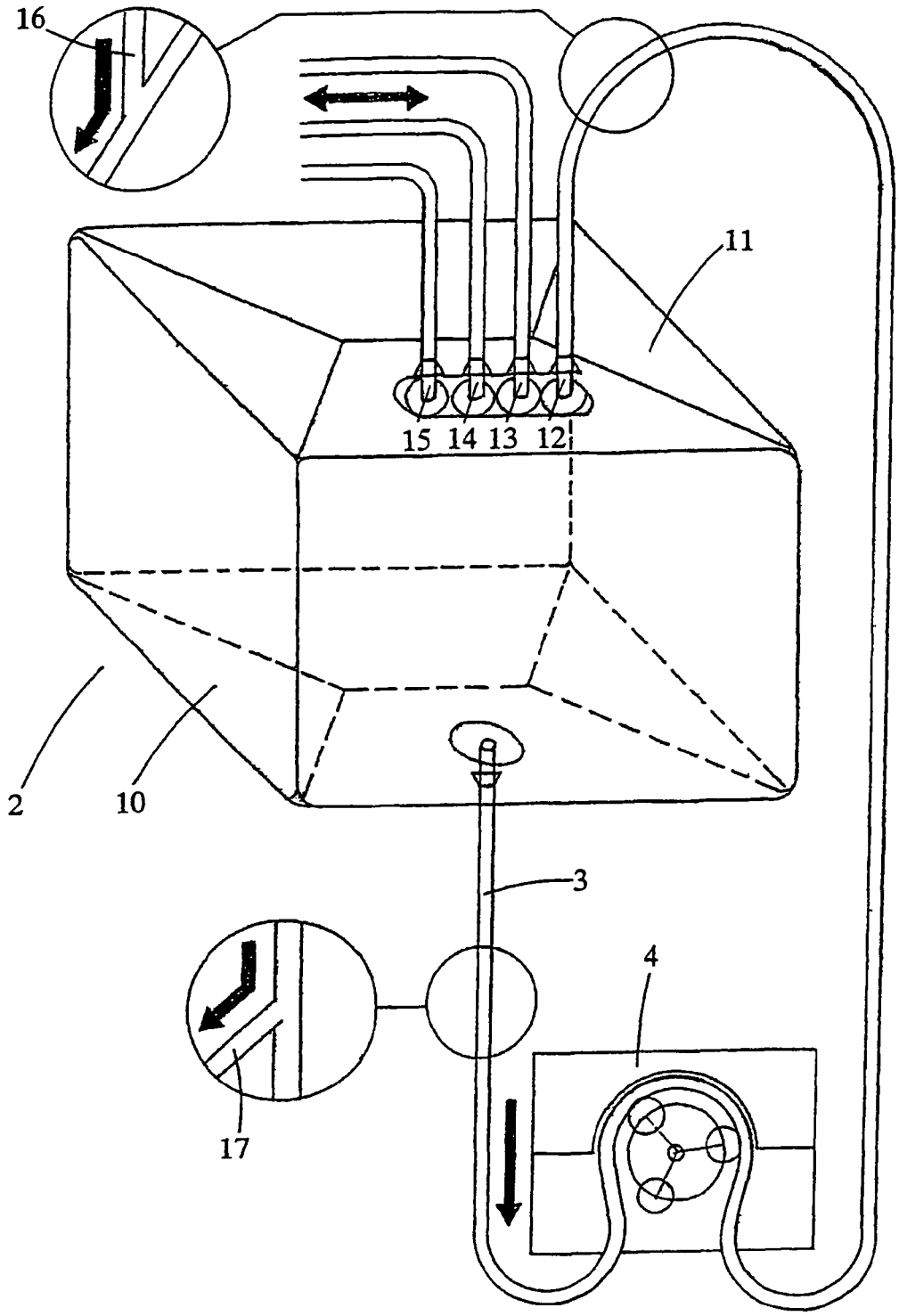
FIG. 3 represents a storage and mixing bag in perspective view as well as a pump used for mixing.

In FIG. 3, a bag 2 is seen for implementing the method according to the invention. This single-use bag 2, of the type described for example in EP-A-1 012 227, in particular includes a bottom wall 10 which comprises an orifice for the liquid to discharge to the outside of the bag, and a top wall 11 which includes an orifice for the liquid to return into the bag. A fixed mixing duct 3 connects, in fluid communication, the discharge orifice and the return orifice arranged on the top wall 11. This duct is long enough to be able to be inserted into a pump 4 forcing a liquid contained in the bag 2 to circulate, being drawn off through the bottom 10 of the bag 2 in order to be poured back into the bag when returning through its top wall 11.

The external mixing duct 3 is attached by each of its ends directly to the surface of the bag, without a dip tube.

The bag 2 represented here also includes, in addition to the door giving access to the interior of the bag 12 on which the fixed mixing duct 3 is installed, three other doors giving access to the interior of the bag, 13, 14, 15 which can in particular serve for the addition of various liquids in order to produce a mixture. In the enlarged section at the top, a variant is represented in which a branch 16 has been installed on the fixed mixing duct 3. Similarly, the enlarged section at the bottom illustrates a variant in which a branch 17 has been installed in the lower part of the mixing duct 3.

Figure 4:
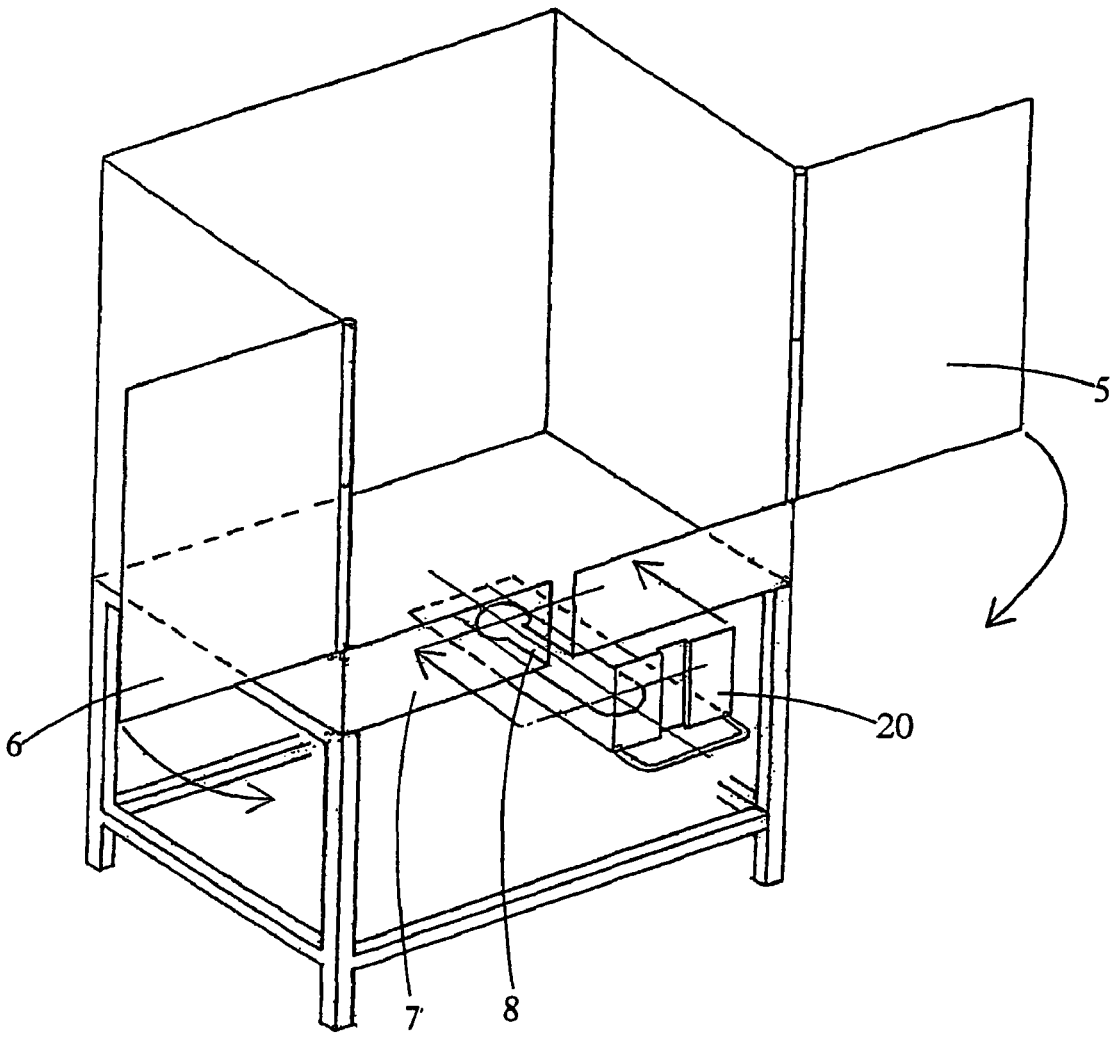
FIG. 4 is a perspective view of a storage and transport device for bags that is used in implementing the mixing method according to the invention.

In FIG. 4, which represents a container 1 according to the invention (without the pump) an elongated slit 8 allowing the passage of a fixed mixing duct 3 can be seen more clearly. A slide valve 20 allows the slit to be partially closed, so as to allow the passage of only the mixing duct 3 and thus firmly support the bottom of the bag.

Figure 5:
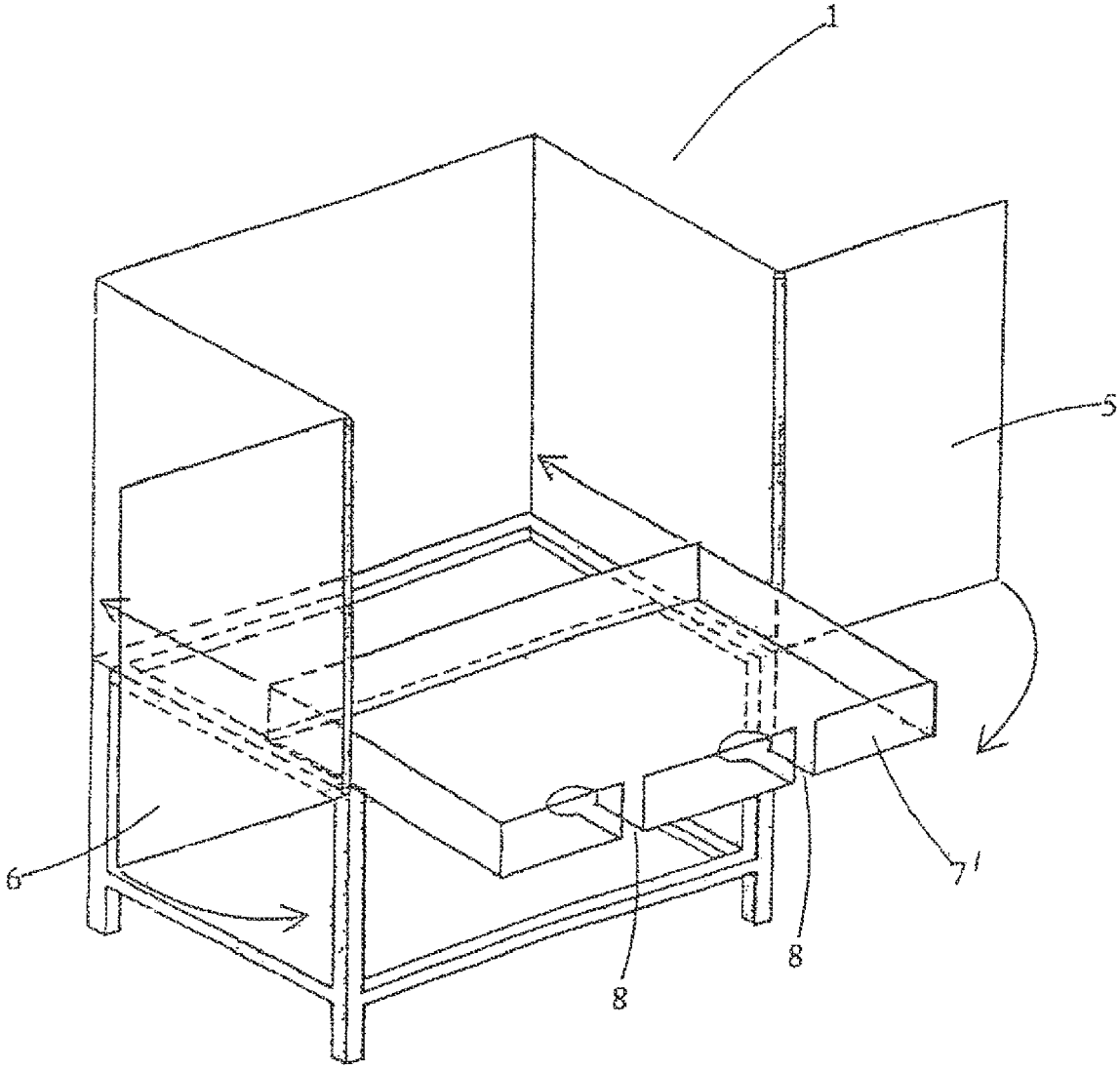
FIG. 5 is a perspective view of a storage and transport device for bags that is used in implementing the mixing method according to the invention.

In FIG. 5 a container 1 according to the invention has been represented, fitted with a bottom wall 7' that can be moved in the manner of a slide valve fitted with two elongated slits 8.

Figure 6:
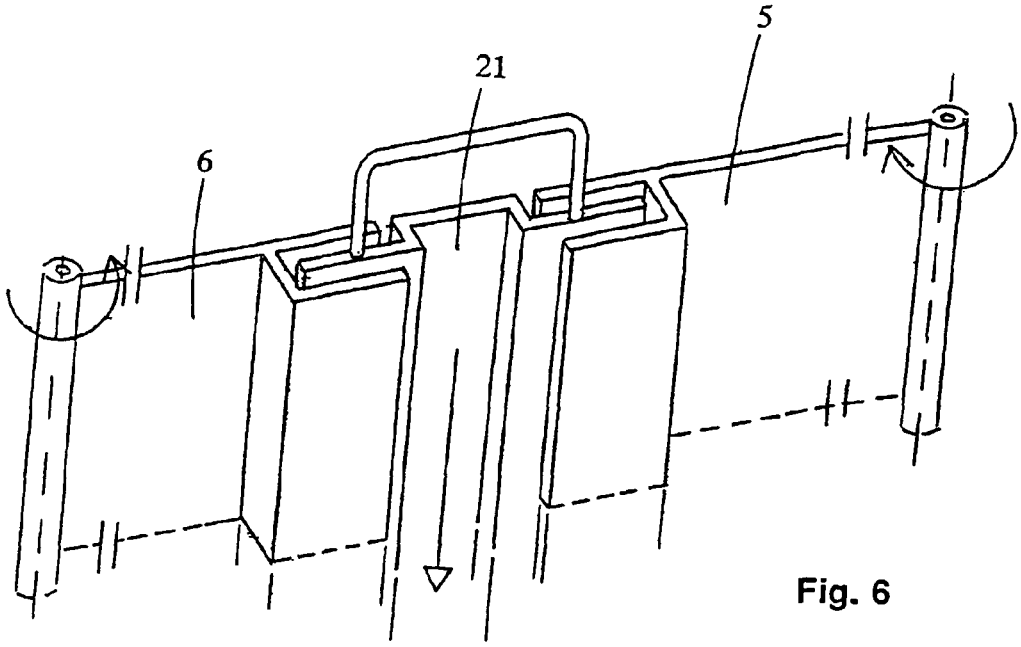
FIG. 6 represents a detail of front-door closing of a transport and mixing device according to the invention.

In FIG. 6 a detail of the closing of doors 5, 6 of a container 1 according to the invention has been represented. The frame edge of the doors 5, 6 is standard, but the flaps comprise a U-section, the openings facing each other, into which a profiled plate 21 is slid and adjusted in order to keep the flaps of the doors 5, 6 in the closed position. The central part 22 of this plate is coplanar with the two doors 5, 6.

Figure 7:
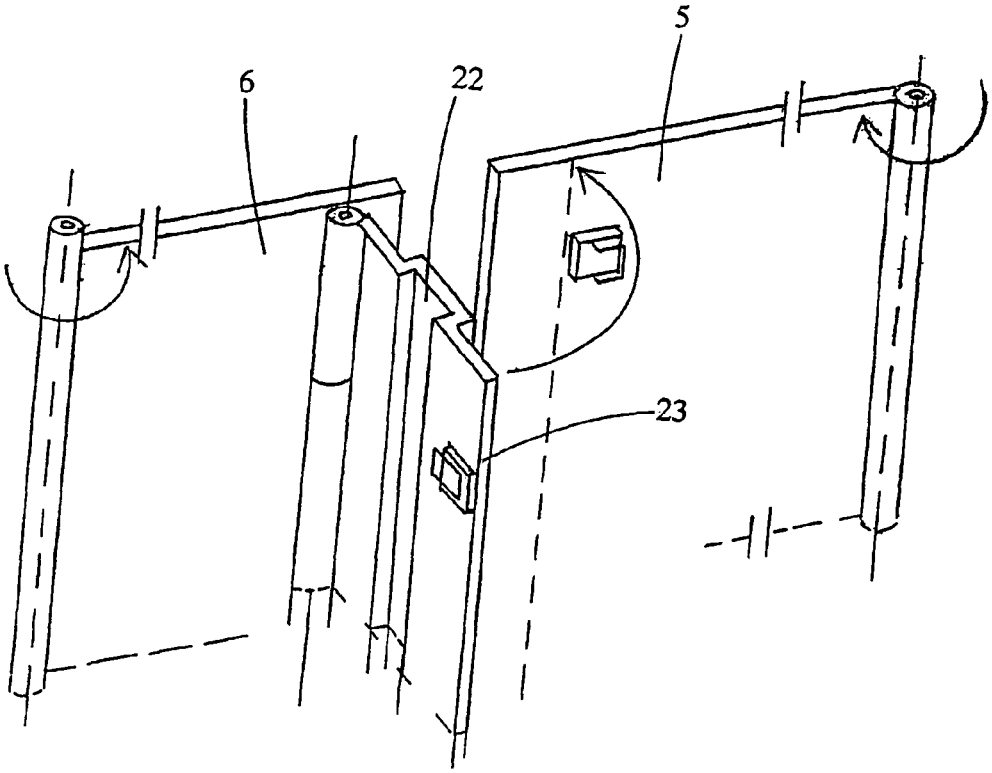
FIG. 7 represents a detail of front-door closing of a storage, transport and mixing device according to the invention.

In FIG. 7 a detail of another type of closing of doors 5, 6 of a container 1 according to the invention has been represented. The frame edge of the side door 5 is standard and the flap comprises a gate 23 fitted with fastenings cooperating with systems provided on the other door 6 in order to keep the flaps of the doors 5, 6 of the container in the closed position. The central part 22 of this gate 23 is coplanar with the two doors 5, 6 of the container.

Figure 8:
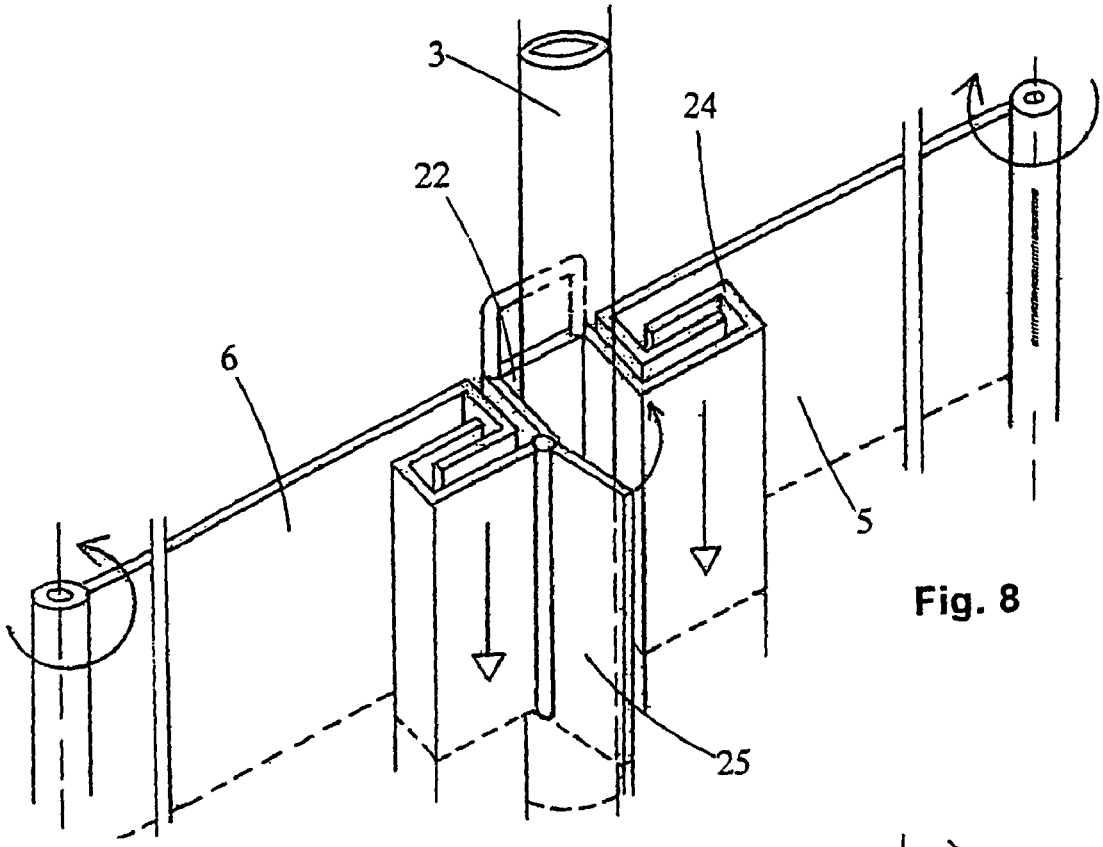
FIG. 8 represents a front-door detail of a storage, transport and mixing device according to the invention.

In FIG. 8 a detail of closing of doors 5, 6 of a container 1 according to the invention can be seen. The frame edge of the doors 5, 6 of the container is standard but the flaps comprise a U-section, the openings being turned away from each other, into which a profiled plate 24 is slid and adjusted in order to keep the flaps of the doors 5, 6 in the closed position. The central part 22 of this plate is coplanar with the two doors 5, 6 and forms a channel in which the mixing duct 3 can be installed in order to protect it, using a gate flap.

Figure 9:
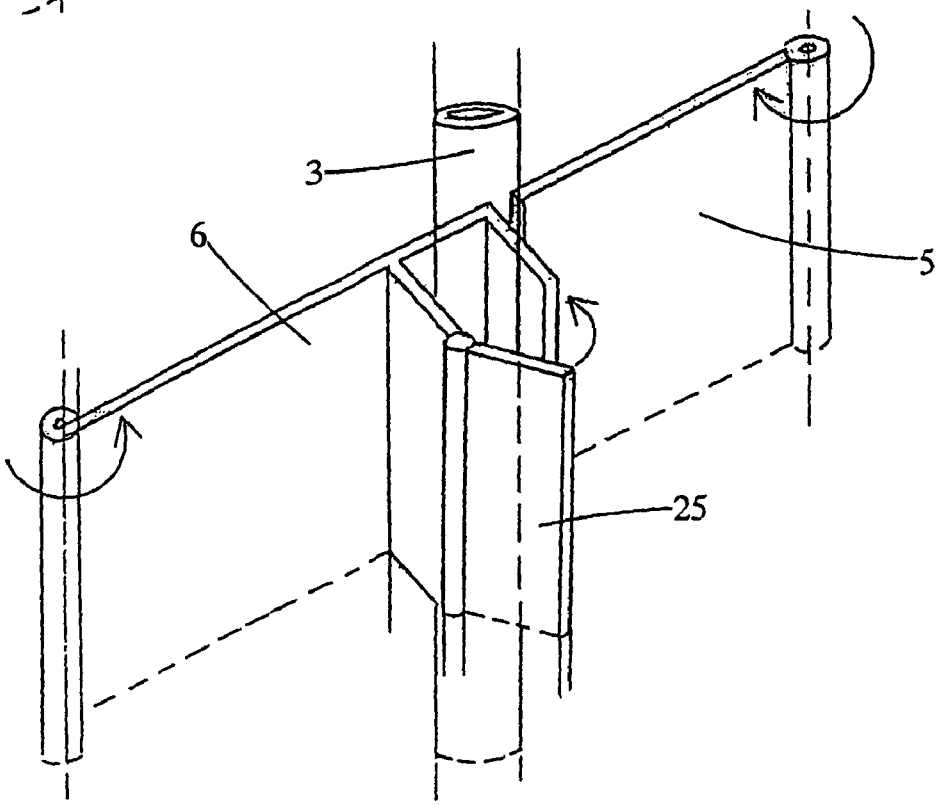
FIG. 9 represents a front-door detail of a storage, transport and mixing device according to the invention.

In FIG. 9, the protection of the mixing duct 3 is integrated in the door 6 of the container and also comprises a gate flap.

Figure 10:
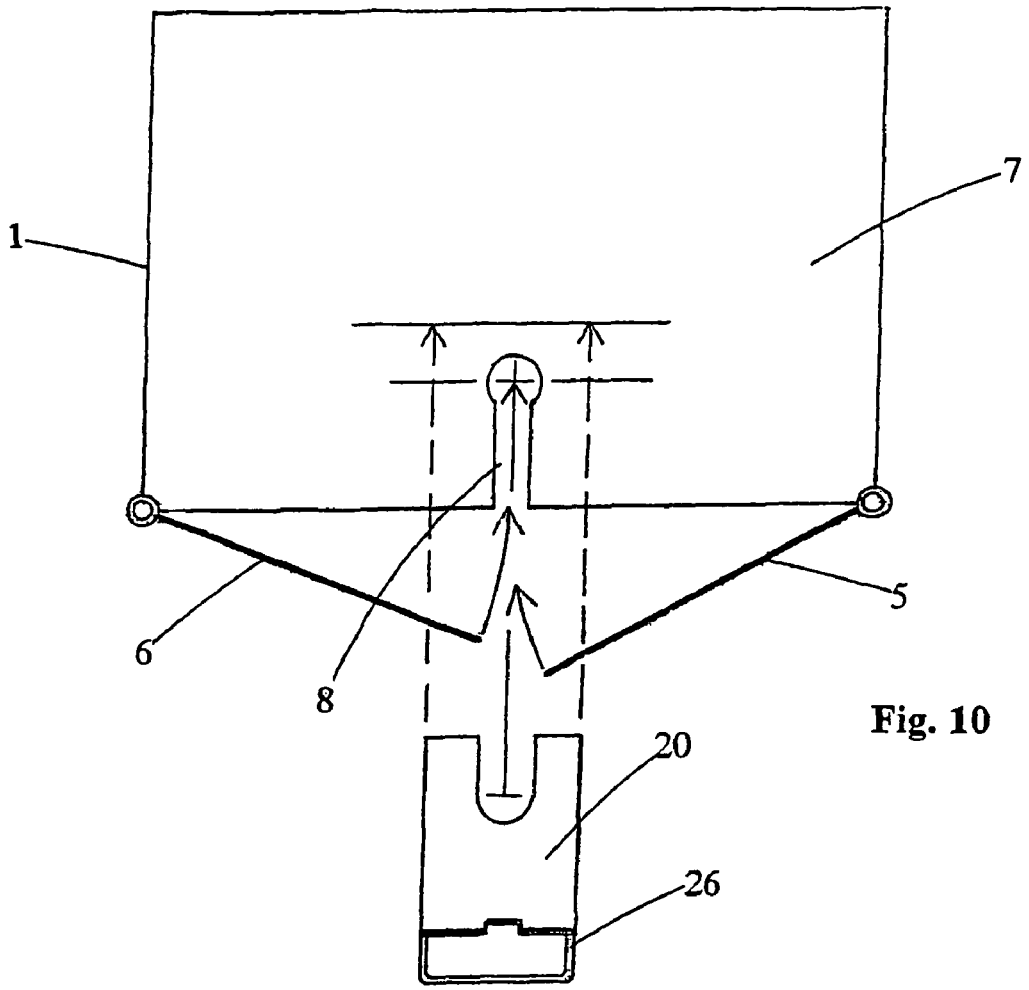
FIGS. 10 and 11 represent a top view of a detail of the bottom wall of a storage, transport and mixing device according to the invention.
Figure 11:
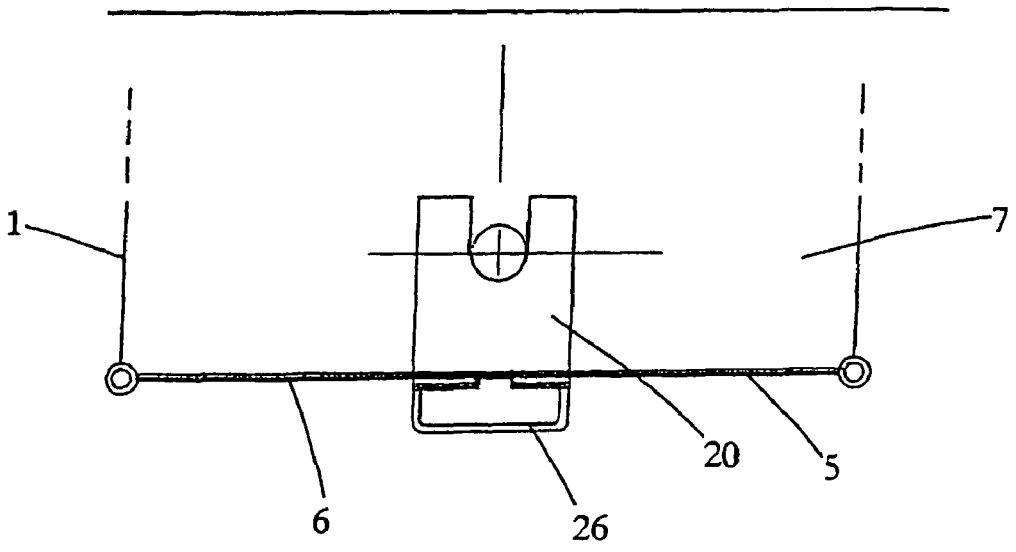

FIGS. 10 and 11 illustrate how to close the bottom wall of the container over the mixing duct 3 after installation of a bag.

Figure 12:
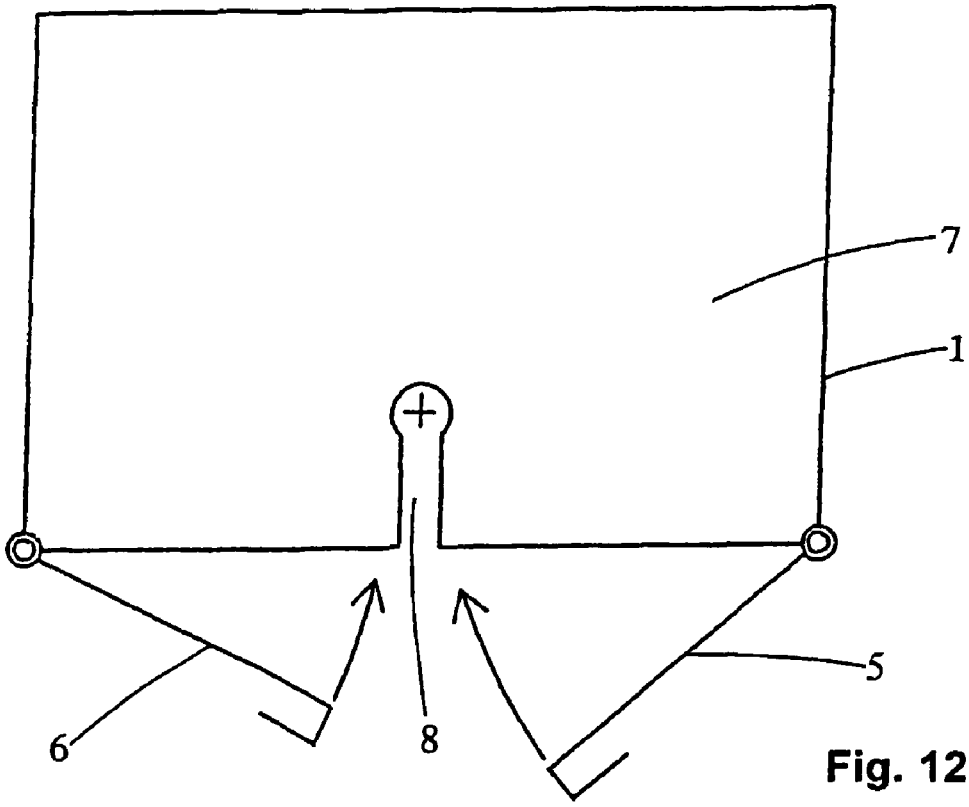
FIG. 12 represents a variant embodiment of the device illustrated in FIG. 11.
Figure 13:
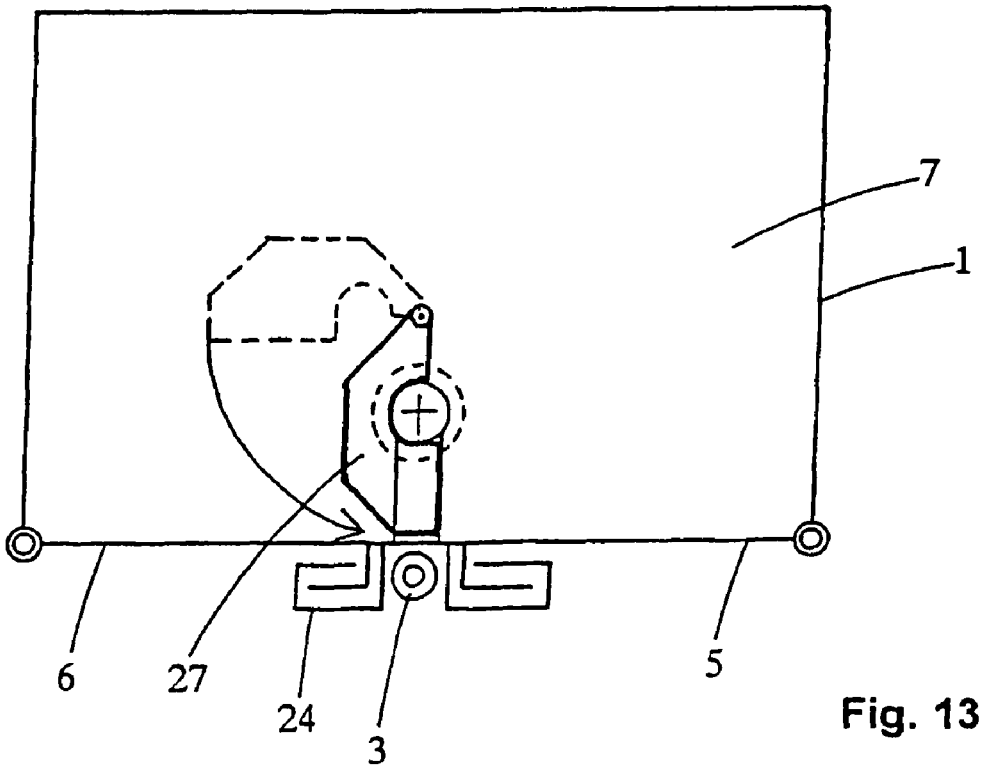
FIG. 13 represents a top view of a detail of the bottom wall of a storage, transport and mixing device according to the invention.

FIG. 12 illustrates in a top view a variant of FIG. 10, fitted with individual door flaps 5, 6 mounted in the closed position in FIG. 13.

FIG. 13 illustrates in a top view in particular the sealing of the bottom slit 8 of the container, after the passage and installation of the fixed duct 3 (not represented), by means of a rotary guillotine closing system 27, as well as the sealing of the front face of the container, after the passage of the fixed duct 3, by means of a U-section 24 slid between the door flaps, according to the embodiment of FIG. 8. The fixed duct crosses the plane of this figure in two places, namely the bottom 7 (duct not represented) and the central space of the closure section 24 (duct 3 represented).

The invention claimed is:

1. A closed single-use system for mixing, storing and homogenizing liquids, comprising:

a rigid container (1) fitted with a non-invasive pump (4), said container (1) enclosing a generally parallelepipedic single-use bag (2), wherein the lower face of the bag includes an orifice for the liquid to discharge to the outside of the bag, the upper face includes an orifice for the liquid to return through which said liquid returns to the inside of the bag, said orifices being connected in fixed manner by an external mixing duct (3) which is inserted into the pump (4) which, during operation, allows the closed-circuit circulation of the liquid taken from the bottom of said bag (2), the pump (4) being open so that the mixing duct (3) is insertable into and extractable from the pump, wherein the mixing duct is connected to the upper face of the single-use bag so that the mixing duct discharges directly into an upper-most part of the bag, and wherein the mixing duct is connected to the lower face of the single-use mixing bag so that the mixing duct takes in fluid directly from a lower-most part of the bag opposite the upper-most part.

2. The system according to claim 1, wherein a bottom (7) of the container (1) is fitted with an elongated slit (8) allowing the insertion and the passage of the mixing duct (3).

3. The system according to claim 2, further comprising a device (20, 27) which can be shifted parallel to the bottom of the container in order to partially close the slit (8).

4. The system according to claim 1, wherein the container (1) includes one or two side doors (5, 6) in order to allow the installation of the bag (2).

5. The system according to claim 4, comprising two of the side doors (5, 6) that each has a flap that comprises a vertical U-section, the U-sections having openings facing each other and into which a profiled plate (21) is slid and adjusted in order to keep the flaps of the side doors (5, 6) held in the closed position.

6. The system according to claim 5, wherein a central part of the profiled and adjusted plate (24) is coplanar with the internal surface of the two side doors (5, 6).

7. The system according to claim 4, comprising two of the side doors (5, 6) that each has a flap that includes a gate (23) fitted with fastenings cooperating with systems provided on the other side door (5, 6) in order to keep said flaps in the closed position.

8. The system according to claim 7, wherein a central part (22) of said gate (23) is coplanar with the internal surface of the two side doors (5, 6) of the container (1).

9. The system according to claim 4, comprising two of the side doors (5, 6) that each has a flap with a U-section, the U-sections having openings turned away from each other and into which a profiled plate is slid and adjusted (24), the plate comprising two U-bends, the openings facing each other, in order to keep the flaps of the side doors (5, 6) in the closed position.

10. The system according to claim 9, wherein a central part (22) of the profiled and adjusted plate (24) is coplanar with the two side doors (5, 6) and forms a channel in which the mixing duct (3) can be installed in order to protect it.

11. The system according to claim 1, wherein a protection of the mixing duct (3) is integrated in a door (6) of the container that includes a gate flap (25).

12. A closed single-use system for mixing, storing and homogenizing liquids, comprising:

a rigid container (1) fitted with a non-invasive pump (4), said container (1) enclosing a generally parallelepipedic single-use bag (2);

wherein the lower face of the bag includes an orifice for the liquid to discharge to the outside of the bag, the upper face includes an orifice for the liquid to return through which said liquid returns to the inside of the bag;

said orifices being connected in fixed manner by an external mixing duct (3) which is inserted into the pump (4) which, during operation, allows the closed-circuit circulation of the liquid taken from the bottom of said bag (2), the pump (4) being open so that the mixing duct (3) is insertable into and extractable from the pump, wherein the container (1) is fitted with a bottom wall (7') which is movable horizontally and is fitted with one or more elongated slits.

13. A method for mixing compounds, comprising the steps of:

installing a single-use bag (2) in a rigid container (1) fitted with a non-invasive pump (4), connecting lower and upper faces of the single-use bag (2) in fixed manner by a mixing duct (3), removably inserting the duct (3) into the non-invasive pump (4), and actuating said pump to produce a closed-circuit circulation of the liquid or liquids introduced into the container (1) in order to carry out the mixing, wherein the connecting step includes connecting the mixing duct to the upper face of the single-use bag so that the mixing duct discharges directly into an upper-most part of the bag, and connecting the mixing duct to the lower face of the single-use mixing bag so that the mixing duct takes in fluid directly from a lower-most part of the bag opposite the upper-most part.

14. The method according to claim 13, wherein the pump (4) causes the mixture to circulate with a flow rate of 6 to 1500 liters per minute.

* * * * *